US007959126B2

(12) United States Patent
Lee

(10) Patent No.: US 7,959,126 B2
(45) Date of Patent: Jun. 14, 2011

(54) MOLDBOARD POSITIONING ASSEMBLY AND USE THEREOF

(76) Inventor: Jen-Hsin Lee, Tainan (TW)

( * ) Notice: Subject to any disclaimer, the term of this patent is extended or adjusted under 35 U.S.C. 154(b) by 900 days.

(21) Appl. No.: 11/865,801

(22) Filed: Oct. 2, 2007

(65) Prior Publication Data

US 2008/0111052 A1 May 15, 2008

(30) Foreign Application Priority Data

Nov. 9, 2006 (TW) ..... 95141498 A

(51) Int. Cl.
*E04G 11/00* (2006.01)

(52) U.S. Cl. ..... 249/40; 249/216

(58) Field of Classification Search ..... 249/40, 249/42, 43, 216, 213, 219.1
See application file for complete search history.

(56) References Cited

U.S. PATENT DOCUMENTS 1,682,740 A * 9/1928 Colt ..... 249/42
2,160,489 A * 5/1939 Spies ..... 52/701
3,181,832 A * 5/1965 Chianese ..... 249/43
3,415,484 A * 12/1968 Hans-Dieter ..... 249/216
3,638,904 A * 2/1972 Franklin et al. ..... 249/213
3,941,346 A * 3/1976 Franc ..... 249/40
4,186,906 A * 2/1980 Koga ..... 249/41
4,192,481 A * 3/1980 Durbin ..... 249/42
5,511,761 A * 4/1996 Schultz ..... 249/34
6,053,681 A * 4/2000 Mattershead ..... 411/195
6,231,025 B1 * 5/2001 Takemura ..... 249/40
2003/0071189 A1 * 4/2003 Petkau ..... 249/190
2005/0218291 A1 * 10/2005 Musk et al. ..... 249/43

FOREIGN PATENT DOCUMENTS

JP 2000336657 * 12/2000

* cited by examiner

*Primary Examiner* — Janet M Wilkens
(74) *Attorney, Agent, or Firm* — Abelman, Frayne & Schwab

(57) ABSTRACT

A moldboard positioning assembly is adapted for positioning at least two spaced-apart moldboards each having at least one through hole. The moldboard positioning assembly includes a spacer block and two threaded connecting poles. The spacer block is adapted for passing through the through hole of one of the moldboards and is adapted to be disposed between and to abut against the moldboards. The threaded connecting poles respectively project from two opposite ends of the spacer block, and each of the threaded connecting poles is adapted to penetrate through the through hole of a corresponding one of the moldboards. The spacer block has a cross section larger than that of the threaded connecting poles.

10 Claims, 5 Drawing Sheets

MOLDBOARD POSITIONING ASSEMBLY AND USE THEREOF

BACKGROUND OF THE INVENTION

1. Field of the Invention

The invention relates to a moldboard positioning assembly, more particularly to a moldboard positioning assembly adapted for positioning at least two spaced-apart moldboards. The invention also relates to a method for positioning spaced-apart moldboards.

2. Description of the Related Art

Referring to FIG. 1, a conventional method for positioning moldboards 11 when performing a cement grouting process includes the steps of: connecting a plurality of supporting poles 12 transversely to and between the moldboards 11 by nailing; penetrating a plurality of spaced-apart threaded poles 14 through the moldboards 11; penetrating the threaded poles 14 through positioning rods 13 so as to mount each of the moldboards 11 between the supporting poles 12 and a corresponding one of the positioning rods 13; and screwing nut members 15 respectively on the threaded poles 14 so as to urge each of the positioning rods 13 to abut against the corresponding one of the moldboards 11. However, in the conventional method, the supporting poles 12 are required to be nailed to the moldboards 11. Therefore, the conventional method is relatively inconvenient.

SUMMARY OF THE INVENTION

An object of the present invention is to provide a moldboard positioning assembly which can be conveniently used to position spaced-apart moldboards. Another object of the present invention is to provide a method for positioning at least two spaced-apart moldboards using the moldboard positioning assembly.

In the first aspect of the present invention, a moldboard positioning assembly, which is adapted for positioning at least two spaced-apart moldboards each having at least one through hole, includes a spacer block and two threaded connecting poles. The spacer block is adapted for passing through the through hole of one of the moldboards and is adapted to be disposed between and to abut against the moldboards. The threaded connecting poles respectively project from two opposite ends of the spacer block, and each of the threaded connecting poles is adapted to penetrate through the through hole of a corresponding one of the moldboards. The spacer block has a cross section larger than that of the threaded connecting poles.

In the second aspect of the present invention, a method for positioning at least two spaced-apart moldboards includes the steps of:

a) providing the moldboards with respective through holes that are aligned with each other;

b) providing a spacer block with two threaded connecting poles that respectively project from two opposite ends of the spacer block;

c) placing the spacer block between the moldboards by passing the spacer block through one of the through holes so that the moldboards are spaced apart by the spacer block;

d) extending the threaded connecting poles through the through holes, respectively; and e) screwing two nut members respectively on the threaded connecting poles so as to urge the moldboards to abut against the spacer block.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
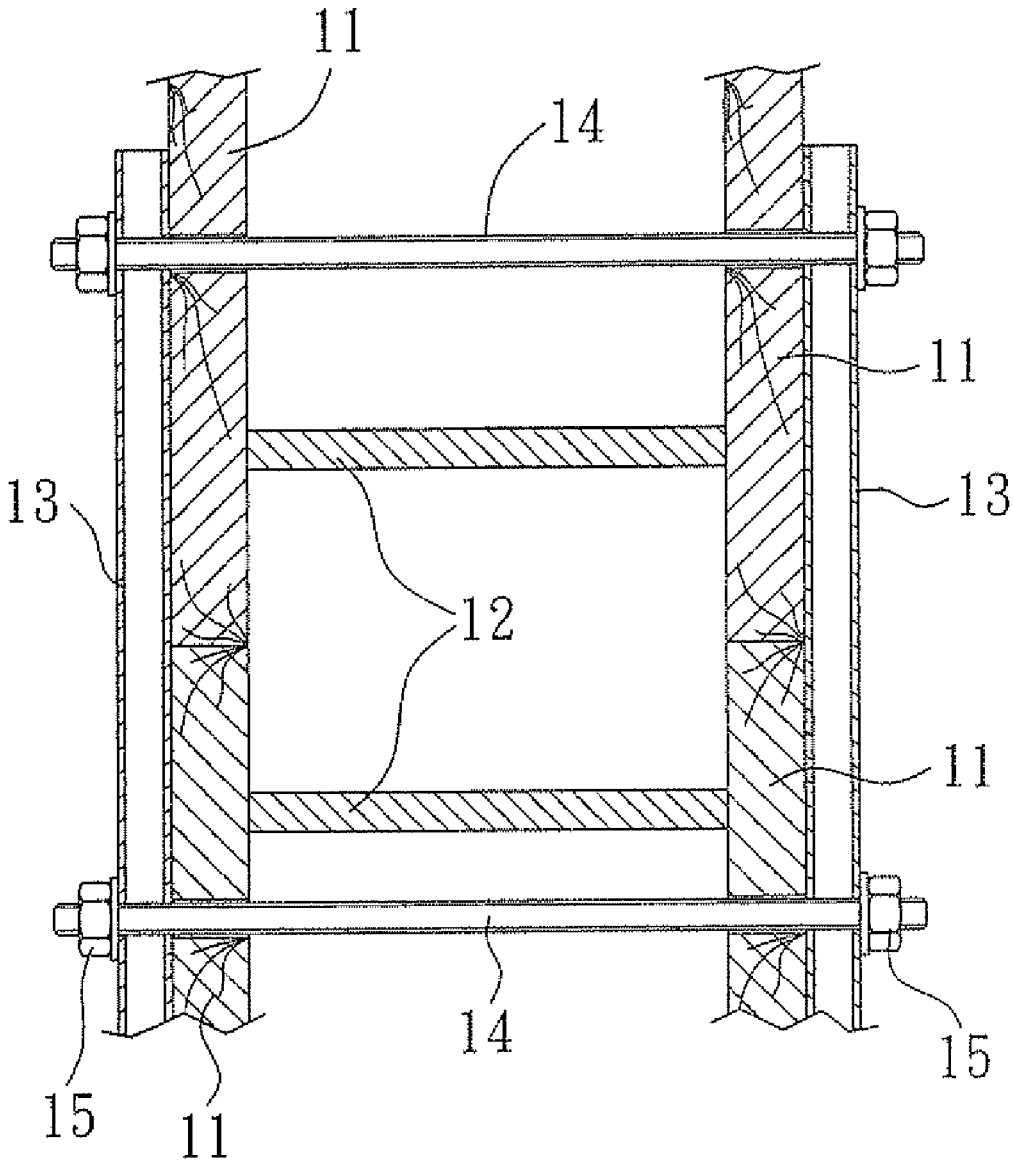
FIG. 1 PRIOR ART
FIG. 1 is a fragmentary sectional view illustrating a conventional method for positioning moldboards.
Figure 2:
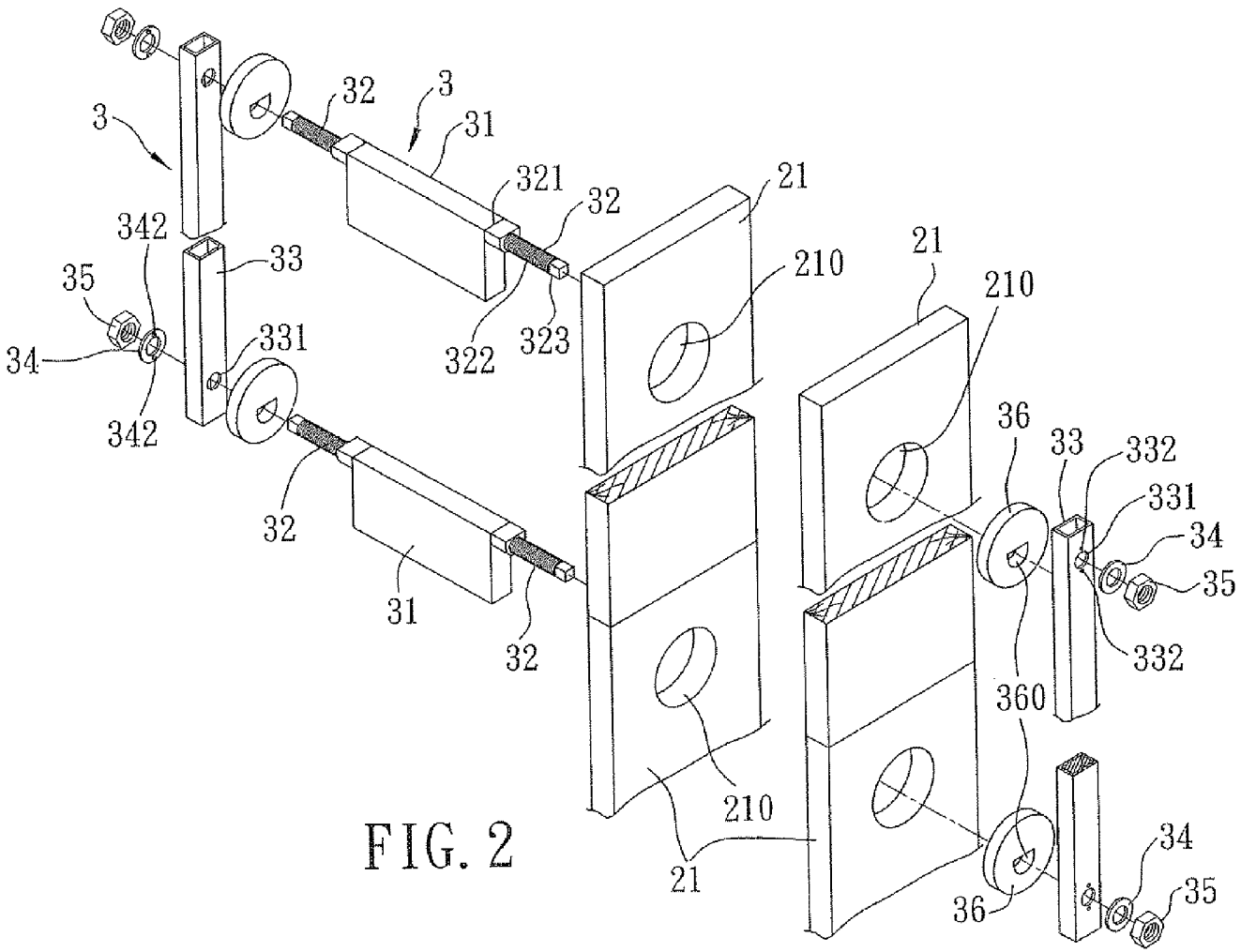
FIG. 2 is an exploded perspective view of a preferred embodiment of a moldboard positioning assembly according to this invention.
Figure 3:
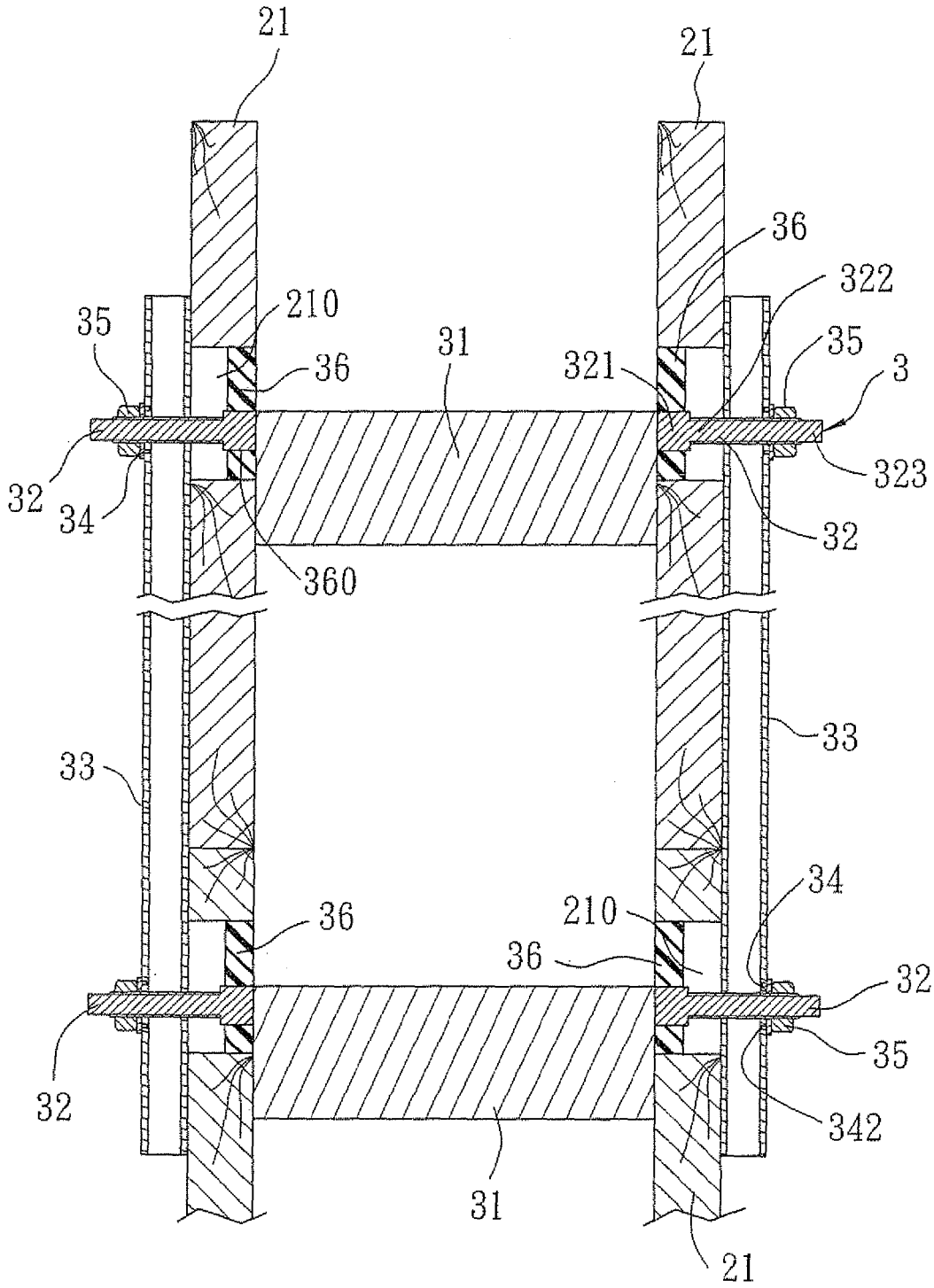
FIG. 3 is a fragmentary sectional view of the preferred embodiment.

Referring to FIGS. 2 and 3, the preferred embodiment of a moldboard positioning assembly 3 according to this invention is shown to be adapted for positioning spaced apart moldboards 21, each of which has at least one through hole 210. In a cement grouting process, a plurality of the moldboard positioning assemblies 3 are used for positioning the moldboards 21.

The moldboard positioning assembly 3 includes a spacer block 31, two threaded connecting poles 32, two nut members 35, two positioning rods 33, two washers 34, and two blocking rings 36.

The spacer block 31 is adapted for passing through the through hole 210 of one of the moldboards 21 and is adapted to be disposed between and to abut against the moldboards 21.

The threaded connecting poles 32 respectively project from two opposite ends of the spacer block 31, and each of the threaded connecting poles 32 is adapted to penetrate through the through hole 210 of a corresponding one of the moldboards 21. The spacer block 31 has a cross section larger than that of the threaded connecting poles 32. In the preferred embodiment, the threaded connecting poles 32 are connected to the opposite ends of the spacer block 31 by welding. Additionally, the threaded connecting poles 32 can be connected to the opposite ends of the spacer block 31 by other manners, such as by screwing.

Each of the threaded connecting poles 32 includes a threaded section 322 adapted for extending through the through hole 210 of the corresponding one of the moldboards 21, an insert section 321 extending between the threaded section 322 and the spacer block 31, and a polygonal turning end portion 323 protruding from the threaded section 322 and disposed opposite to the spacer block 31. In the preferred embodiment, the insert section 321 has a non-circular cross section (e.g., a semi-circular cross section), which is larger than a cross section of the threaded section 322. Moreover, the turning end portion 323 is tetragonal in the preferred embodiment.

The nut members 35 are respectively screwed on the threaded connecting poles 32 and are to be disposed outside the moldboards 21 for urging the moldboards 21 to abut against the spacer block 31.

Each of the positioning rods 33 is penetrated by the threaded section 322 of a corresponding one of the threaded connecting poles 32, is positioned opposite to the spacer block 31, and is adapted for abutting against a corresponding one of the moldboards 21. Each of the positioning rods 33 has at least one through hole 331 for extension of the corresponding one of the threaded connecting poles 32, and two positioning holes 332 angularly spaced apart from each other around the through hole 331.

Each of the washers 34 is mounted on the threaded section 322 of a corresponding one of the threaded connecting poles 32 between a corresponding one of the positioning rods 33 and a corresponding one of the nut members 35. Each of the washers 34 has two angularly spaced-apart positioning protrusions 342 respectively engaging the positioning holes 332.

Each of the blocking rings 36 is made of a plastic material in the preferred embodiment, is adapted to be fitted in the through hole 210 of a corresponding one of the moldboards 21, and has a slot 360 that permits one of the threaded connecting poles 32 to extend therethrough. The slot 360 of each of the blocking rings 36 is eccentric with respect to the center of the through hole 210 of the corresponding one of the moldboards 21. The insert section 321 of each of the threaded connecting poles 32 has a cross section corresponding to the shape of the slot 360 and extends through the slot 360 of a corresponding one of the blocking rings 36 so as to position the insert section 321 of each of the threaded connecting poles 32 in the slot 360 of the corresponding one of the blocking rings 36.

Figure 4:
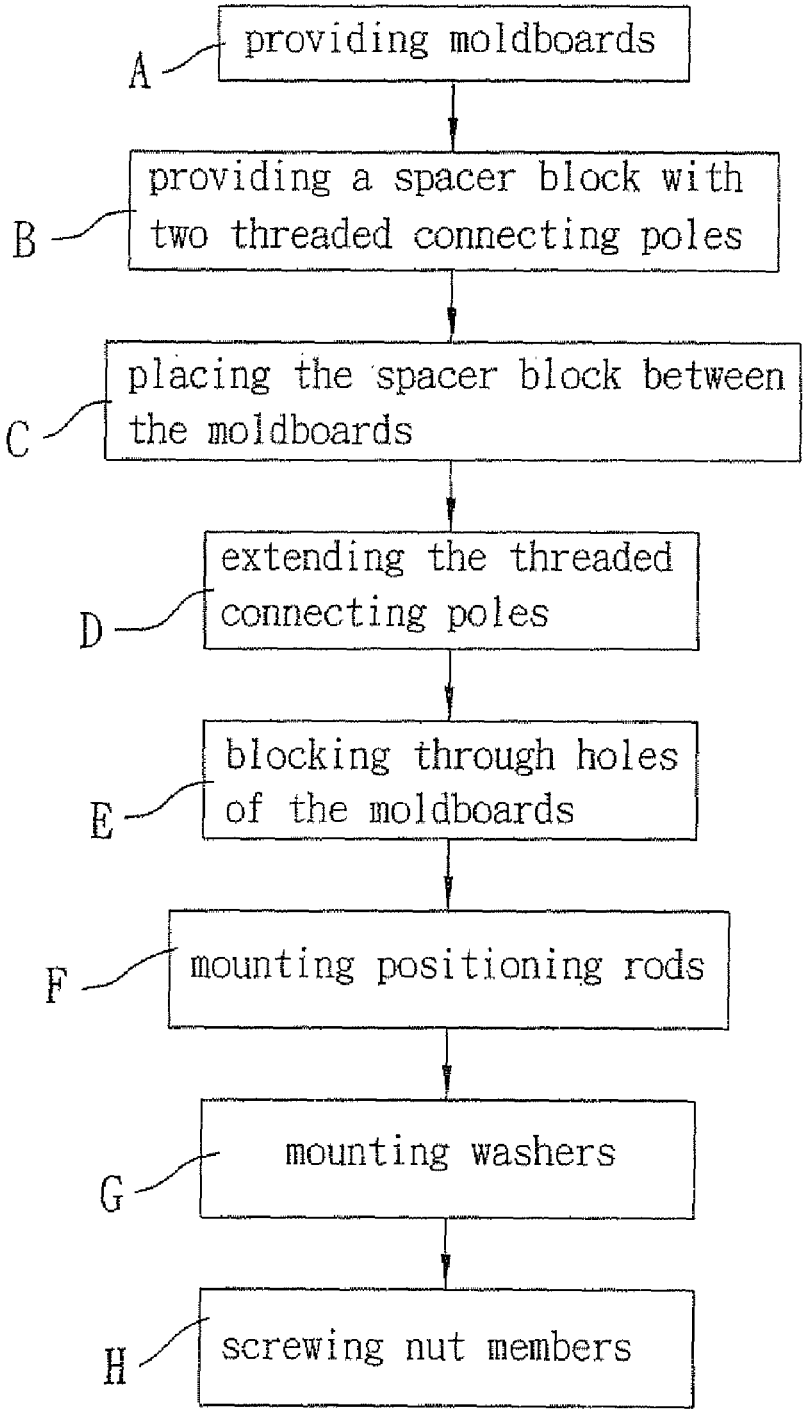
FIG. 4 is a flow diagram of a preferred embodiment of a method for positioning at least two spaced-apart moldboards according to this invention.

Referring to FIGS. 2, 3, and 4, the preferred embodiment of a method for positioning the moldboards 21 according to this invention includes the steps of:

A) providing the moldboards 21:

The moldboards 21 have respective through holes 210 that are aligned with each other. In the preferred embodiment, each of the through holes 210 has a circular shape.

B) providing the spacer block 31 with two threaded connecting poles 32:

In the preferred embodiment, the threaded connecting poles 32 are connected to two opposite ends of the spacer block 31 by welding, and respectively project from the opposite ends of the spacer block 31.

C) placing the spacer block 31 between the moldboards 21:

The spacer block 31 is placed between the moldboards 21 by passing the spacer block 31 through one of the through holes 210 so that the moldboards 21 are spaced apart by the spacer block 31. At least a portion of the spacer block 31 is placed out of alignment with the through holes 120 of the moldboards 21 so that the portion of the spacer block 31 abuts against the moldboards 21. To this end, in the preferred embodiment, the spacer block 31 is arranged to be asymmetric with respect to the center of each of the through holes 210. Furthermore, the spacer block 31 is also asymmetric with respect to the threaded connecting poles 32.

D) extending the threaded connecting poles 32:

The threaded connecting poles 32 are extended through the through holes 210 of the moldboards 21, respectively.

E) blocking the through holes 210 of the moldboards 21:

Each of the blocking rings 36 is inserted in the corresponding one of the through holes 210 of the moldboards 21, and each of the threaded connecting poles 32 extends through the slot 360 of the corresponding one of the blocking rings 36 so as to position the insert section 321 of each of the threaded connecting poles 32 in the slot 360 of the corresponding one of the blocking rings 36. The through holes 210 of the moldboards 21 can be blocked by the blocking rings 36 to prevent the spacer block 31 from being released through the through holes 210 while permitting the threaded connecting poles 32 to extend through the through holes 210.

F) mounting the positioning rods 33:

Each of the positioning rods 33 is penetrated by the threaded section 322 of the corresponding one of the threaded connecting poles 32, and abuts against the corresponding one of the moldboards 21.

G) mounting the washers 34:

Each of the washers 34 is mounted on the threaded section 322 of the corresponding one of the threaded connecting poles 32 and is disposed outside the corresponding one of the positioning rods 33. The positioning protrusions 342 of each of the washers 34 respectively engage the positioning holes 332 of the corresponding one of the positioning rods 33.

H) screwing the nut members 35:

The nut members 35 are respectively screwed on the threaded connecting poles 32 so as to urge the moldboards 21 to abut against the spacer block 31.

Since the positioning protrusions 342 of each of the washers 34 respectively engage the positioning holes 332 of the corresponding one of the positioning rods 33, and since each of the washers 34 has a circular hole substantially equal to the cross section of each of the threaded connecting poles 32, the threaded connecting poles 32 will not oscillate while screwing the nut members 35 on the threaded connecting poles 32. Furthermore, since the slot 360 of each of the blocking rings 36 is eccentric with respect to the center of the corresponding one of the through holes 210 of the moldboards 21, the spacer block 31 will not oscillate or deviate while screwing the nut members 35 on the threaded connecting poles 32.

Since the moldboards 21 are abutted between the spacer block 31 and the positioning rods 33, the moldboards 21 can be positioned precisely during the cement grouting process.

Figure 5:
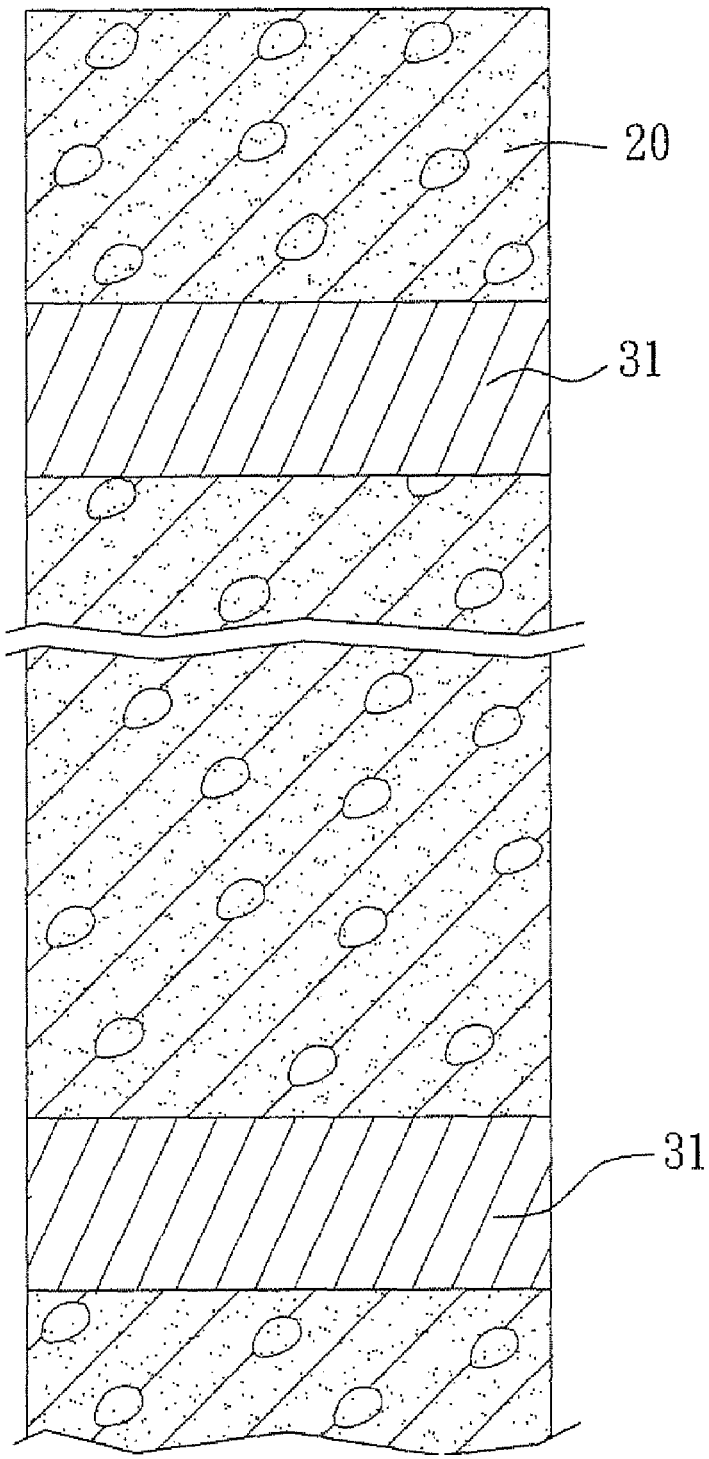
FIG. 5 is a fragmentary sectional view of a concrete wall formed by the preferred embodiments.

Referring to FIGS. 3 and 5, the nut members 35, the washers 34, and the positioning rods 33 are dismounted sequentially after the cement is solidified. The threaded connecting poles 32 are disconnected from the spacer block 31 by breaking each of the threaded connecting poles 32 at the insert section 321 using a tool, such as a spanner. Finally, the moldboards 21 are dismounted to obtain a molded cement structure 20, such as a molded cement wall. As shown in FIG. 5, since the spacer block 31 will not protrude out of the molded cement structure 20, it is not required to further trim the spacer block 31.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A moldboard positioning assembly adapted for positioning at least two spaced-apart moldboards each having at least one through hole, comprising:

a spacer block adapted for passing through the through hole of one of the moldboards and adapted to be disposed between and to abut against the moldboards;

two threaded connecting poles respectively projecting from two opposite ends of said spacer block, each adapted to penetrate through the through hole of a corresponding one of the moldboards, wherein each of said threaded connecting poles includes a threaded section adapted for extending through the through hole of the corresponding one of the moldboards, and a polygonal turning end portion protruding from said threaded section and disposed opposite to said spacer block;

two nut members respectively screwed on said threaded connecting poles and to be disposed outside the moldboards for urging the moldboards to abut against said spacer block;

at least one positioning rod penetrated by said threaded section of a corresponding one of said threaded connecting poles, positioned opposite to said spacer block, and adapted for abutting against a corresponding one of the moldboards; and at least one washer mounted on said threaded section of a corresponding one of said threaded connecting poles between said positioning rod and a corresponding one of said nut members;

wherein said spacer block has a cross section larger than that of said threaded connecting poles.

2. The moldboard positioning assembly as claimed in claim 1, wherein said positioning rod has at least one through hole for extension of the corresponding one of said threaded connecting poles, and two positioning holes angularly spaced apart from each other around said through hole of said positioning rod, said washer having two angularly spaced-apart positioning protrusions respectively engaging said positioning holes.

3. A moldboard positioning assembly adapted for positioning at least two spaced-apart moldboards each having at least one through hole, comprising:

a spacer block adapted for passing through the through hole of one of the moldboards and adapted to be disposed between and to abut against the moldboards;

two threaded connecting poles respectively projecting from two opposite ends of said spacer block, each adapted to penetrate through the through hole of a corresponding one of the moldboards, wherein each of said threaded connecting poles includes a threaded section adapted for extending through the through hole of the corresponding one of the moldboards, and a polygonal turning end portion protruding from said threaded section and disposed opposite to said spacer block;

two nut members respectively screwed on said threaded connecting poles and to be disposed outside the moldboards for urging the moldboards to abut against said spacer block; and blocking rings each adapted to be fitted in the through hole of a corresponding one of the moldboards and each having a slot that permits one of said threaded connecting poles to extend therethrough, said slot of each of said blocking rings being eccentric with respect to the center of the through hole of the corresponding one of the moldboards;

wherein said spacer block has a cross section larger than that of said threaded connecting poles.

4. The moldboard positioning assembly as claimed in claim 3, wherein each of said threaded connecting poles further includes an insert section extending between said threaded section and said spacer block and through said slot, said insert section having a non-circular cross section.

5. The moldboard positioning assembly as claimed in claim 3, wherein said blocking rings are made of a plastic material.

6. A method for positioning at least two spaced-apart moldboards, comprising the steps of:

a) providing the moldboards with respective through holes that are aligned with each other;

b) providing a spacer block with two threaded connecting poles that respectively project from two opposite ends of the spacer block;

c) placing the spacer block between the moldboards by passing the spacer block through one of the through holes so that the moldboards are spaced apart by the spacer block;

d) extending the threaded connecting poles through the through holes, respectively; and e) screwing two nut members respectively on the threaded connecting poles so as to urge the moldboards to abut against the spacer block.

7. The method as claimed in claim 6, further comprising a step of blocking the through holes of the moldboards by respectively inserting blocking rings in the through holes of the moldboards so as to prevent the spacer block from being released through the through holes of the moldboards while permitting the threaded connecting poles to extend through the through holes of the moldboards before the step e).

8. The method as claimed in claim 7, wherein the blocking rings are respectively provided with slots to permit the threaded connecting poles to extend therethrough, respectively.

9. The method as claimed in claim 8, wherein, in the step c), at least a portion of the spacer block is placed out of alignment with the through holes of the moldboards so that the portion of the spacer block abuts against the moldboards.

10. The method as claimed in claim 9, wherein, in the step b), the threaded connecting poles are connected to the opposite ends of the spacer block by welding.

* * * * *